US008291718B2

(12) United States Patent
Junge et al.

(10) Patent No.: US 8,291,718 B2
(45) Date of Patent: Oct. 23, 2012

(54) DSM DEFROST DURING HIGH DEMAND

(75) Inventors: Brent Alden Junge, Evansville, IN (US); Joseph Thomas Waugh, Louisville, KY (US); Jeffrey Wood, Louisville, KY (US)

(73) Assignee: General Electric Company, Schenectady, NY (US)

( * ) Notice: Subject to any disclaimer, the term of this patent is extended or adjusted under 35 U.S.C. 154(b) by 250 days.

(21) Appl. No.: 12/874,320

(22) Filed: Sep. 2, 2010

(65) Prior Publication Data

US 2012/0055179 A1 Mar. 8, 2012

(51) Int. Cl.
*F25D 21/00* (2006.01)

(52) U.S. Cl. ..... 62/80

(58) Field of Classification Search ..... 62/80, 151, 62/234, 154, 155, 163, 126, 127, 129; 700/276, 700/204, 300

See application file for complete search history.

(56) References Cited

U.S. PATENT DOCUMENTS

| | | | | |
|---|---|---|---|---|
| 4,110,997 | A * | 9/1978 | Klotz et al. | 62/81 |
| 4,530,217 | A * | 7/1985 | Alluto et al. | 62/156 |
| 4,938,027 | A * | 7/1990 | Midlang | 62/80 |
| 5,493,867 | A * | 2/1996 | Szynal et al. | 62/80 |
| 5,533,360 | A * | 7/1996 | Szynal et al. | 62/298 |
| 6,619,058 | B2 * | 9/2003 | Cho et al. | 62/156 |
| 6,631,620 | B2 * | 10/2003 | Gray et al. | 62/156 |
| 6,694,753 | B1 * | 2/2004 | Lanz et al. | 62/155 |
| 6,782,491 | B1 * | 8/2004 | Foedlmeier et al. | 714/37 |
| 6,851,270 | B2 * | 2/2005 | Denvir | 62/234 |
| 7,984,617 | B2 * | 7/2011 | Kim et al. | 62/228.5 |
| 2004/0153170 | A1 * | 8/2004 | Santacatterina et al. | 700/1 |
| 2005/0044437 | A1 * | 2/2005 | Dunstan et al. | 713/322 |
| 2005/0194456 | A1 * | 9/2005 | Tessier et al. | 236/51 |
| 2007/0033955 | A1 * | 2/2007 | Luo et al. | 62/150 |
| 2010/0070091 | A1 | 3/2010 | Watson et al. | |
| 2010/0070099 | A1 | 3/2010 | Watson et al. | |

* cited by examiner

*Primary Examiner* — Mohammad Ali
(74) *Attorney, Agent, or Firm* — Global Patent Operation; Douglas D. Zhang

(57) ABSTRACT

A method includes providing a standard supply of electrical power to a defrost heater during a standard defrost cycle for a refrigeration system of an appliance, detecting a high energy demand period during the standard defrost cycle, and enabling a reduced consumption of electrical power by the defrost heater in a low power defrost cycle.

20 Claims, 7 Drawing Sheets

DSM DEFROST DURING HIGH DEMAND

BACKGROUND OF THE INVENTION

The present disclosure relates generally to refrigerators, and more particularly to a defrost heater system for a refrigerator.

Most refrigerators, such as that as disclosed in U.S. Pat. No. 5,711,159, include an evaporator that normally operates at sub-freezing temperatures in a compartment positioned behind the freezer compartment. A layer of frost typically builds up on the surface or coils of the evaporator. Defrost cycles are needed in order to melt any frost or ice that forms or builds upon on the refrigeration coils of the evaporator in a refrigeration system. Typical defrost systems utilize defrost heaters to melt the ice build up. The defrost heater may be similar to the heating elements on an electric stove and can be generally located near or beneath the cooling coils, which are concealed behind a panel in the refrigeration or freezer compartment. During the defrost cycle, the defrost heater gets hot. As a result of its proximity to the cooling coils, any ice or frost build-up on the coils melts. As disclosed in U.S. Pat. No. 5,042,267, filed on Oct. 5, 1990, and assigned to General Electric Company, assignee of the present invention, a radiant heater is often positioned inside a housing and below the evaporator to warm the evaporator by both convection and radiant heating in order to quickly defrost the evaporator.

However, existing radiant defrost heaters consume a significant amount of energy. Demand Side Management (DSM) is growing in importance as it has become recognized that much of the cost of generating electrical power is determined by the peak electrical power demand. The utility industry as well as the government and companies are developing strategies to limit peak electrical power demand by shifting some of the loads from high electrical power demand periods to low electrical power demand periods.

The peak energy use of an appliance such as a refrigerator typically occurs during the defrost cycle. The amount of energy that can be consumed by a refrigerator during a defrost cycle is about 500 watts. The rules agreed to by industry for DSM enabled refrigerators is that during a high electrical power demand period, the energy draw of the refrigerator should be controlled so that it is at most one-half (50%) of the peak refrigerator energy usage.

A DSM enabled refrigerator can be controlled such that a defrost cycle requested or scheduled during a high demand period is delayed. However, there are situations where a defrost cycle is initiated or started during a low demand period and is still in process when a high demand period occurs.

Once a defrost cycle is initiated, it is important to not terminate the defrost cycle until all of the frost or ice buildup has melted. If the defrost cycle is prematurely stopped while there is still a mixture of frost and water on the evaporator, this mixture will have a tendency to refreeze into solid ice. It is much more difficult to remove solid ice from an evaporator than frost. Frost tends to be more evenly distributed than solid ice and is less likely to eventually completely insulate the evaporator and reduce or block airflow. Blocked airflow will result in a service call due to lack of cooling. Thus, an incomplete or skipped defrost cycle can result in an ice-clogged evaporator. It would be advantageous to be able to safely reduce power usage in a refrigerator during a defrost cycle without risking the formation of an ice-clogged evaporator.

Accordingly, it would be desirable to provide a system that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to a method. In one embodiment, the method includes providing a standard supply of electrical power to a defrost heater during a standard defrost cycle for a refrigeration system of an appliance, detecting a high energy demand period during the standard defrost cycle, and enabling a reduced consumption of electrical power by the defrost heater in a low power defrost cycle.

In another aspect, the present disclosure is directed to a control system for a defrost heater in a refrigeration system. In one embodiment the control system includes a power supply connection, a controller configured to determine a demand side management state signal, and a power switching unit coupled between the power supply connection and the defrost heater, the power switching unit configured to switch a power consumption state of the defrost heater in a defrost cycle from a standard power consumption mode to a reduced power consumption mode when the demand side management state signal is detected during the standard consumption mode.

In a further aspect, the present disclosure is directed to a refrigerator. In one embodiment, the refrigerator includes a compartment, an evaporator in heat transfer association with the compartment, a defrost heater associated with the evaporator, and a controller configured to switch an energy consumption state of the defrost heater from a standard energy consumption state to a reduced energy consumption state when a peak power demand state is detected.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
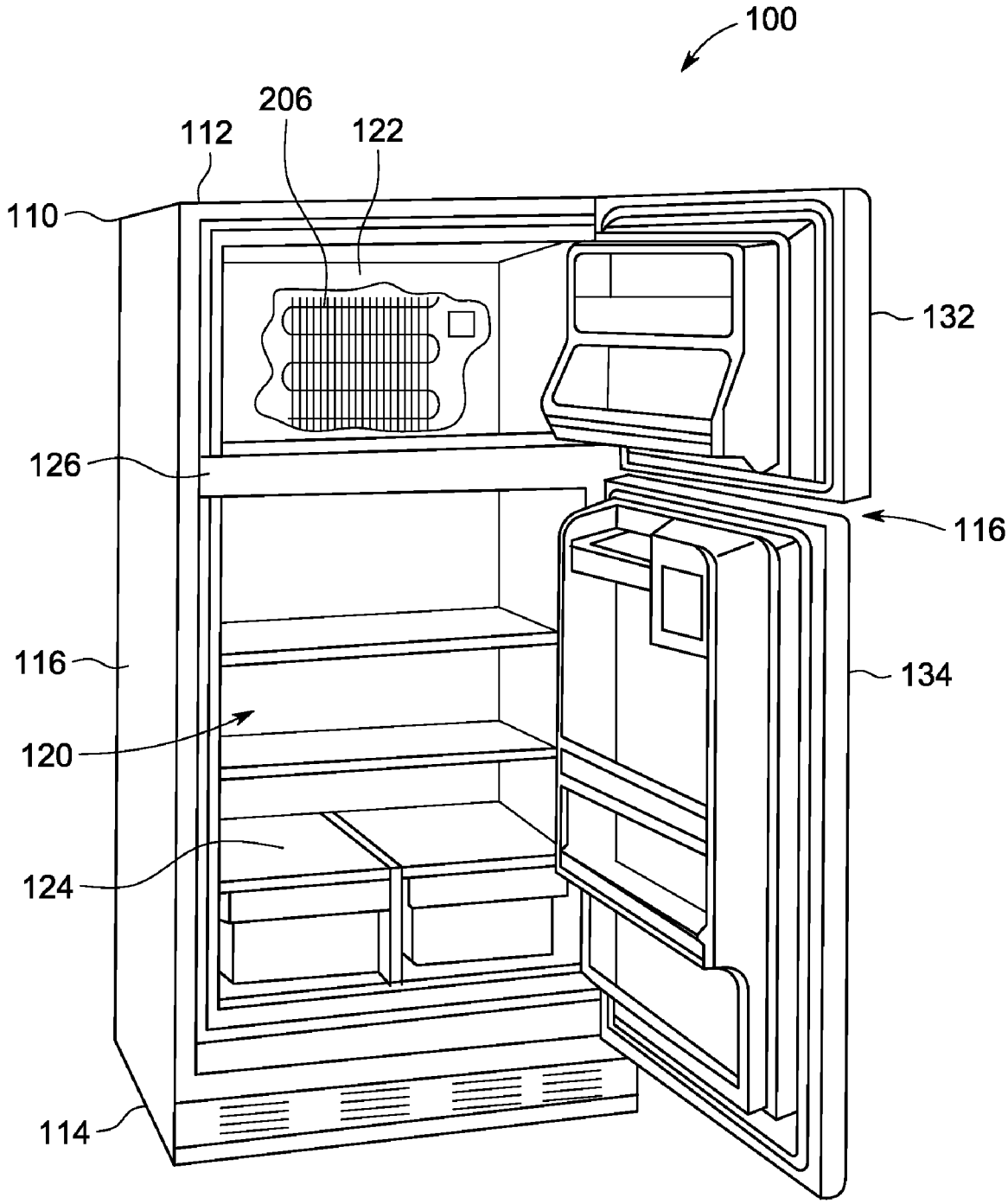
FIG. 1 is a perspective view of one embodiment of an exemplary appliance incorporating aspects of the present disclosure.

Referring to FIG. 1, an exemplary appliance such as a refrigerator, incorporating aspects of the disclosed embodiments is generally designated by reference numeral 100. In this example the appliance 100 is shown as a refrigerator, but in alternate embodiments the appliance may be any suitable cooling or refrigeration appliance that utilizes a radiant heater for a defrost cycle, such as for example an air conditioning unit. The aspects of the disclosed embodiments are generally directed to providing a reduced power consumption state or mode for a defrost heater in a refrigeration and cooling appliance such as a refrigerator. In order to comply with DSM requirements, power consumption of an appliance such as a refrigerator must be able to be reduced by approximately one-half during periods of peak energy usage or demand. The aspects of the disclosed embodiments can detect a need to enter such a reduced power consumption state, generally referred to herein as a "DSM state", and reduce the power consumption of the evaporator heater while still maintaining a suitable length of the defrost cycle to ensure that the defrost cycle is not prematurely terminated, which would result in ice and frost buildup The refrigerator 100 shown in FIG. 1 is a top mount household refrigerator 100 having a body or cabinet 110, which includes a top 112, a bottom 114, and opposed sides 116. As shown in FIG. 1, the top 112, bottom 114 and opposed sides 116 generally define an opening 120. Within the opening 120 is defined an upper compartment 122 and a lower compartment 124, the upper and lower compartments 122, 124 being separated by a mullion 126. In the example of FIG. 1, the upper compartment 122 defines a freezer compartment, while the lower compartment 124 defines a fresh food storage compartment. In alternate embodiments the refrigerator 100 can include any suitable number of compartments, in any suitable configuration or orientation.

As is shown in FIG. 1, each of the compartments 122, 124 may have an access opening, which is normally closed by a door, in this embodiment shown as freezer door 132 and fresh food storage door 134. In alternate embodiments, the freezer and fresh food storage compartments can be arranged in any suitable manner. The aspects of the disclosed embodiments are not limited to a top mount household refrigerator and other refrigerator compartment configurations may include, for example, the fresh food storage compartment mounted above the freezer storage compartment, the fresh food storage compartment and freezer storage compartment mounted side by side, a combination of stacked compartments and side by side compartments, or a single door refrigerator. It is contemplated that the disclosed embodiments are applicable to other types of refrigeration and cooling appliances, such as air conditioners, for example, and are not intended to be limited to any particular type or configuration of the exemplary refrigerator shown in FIG. 1.

Figure 2:
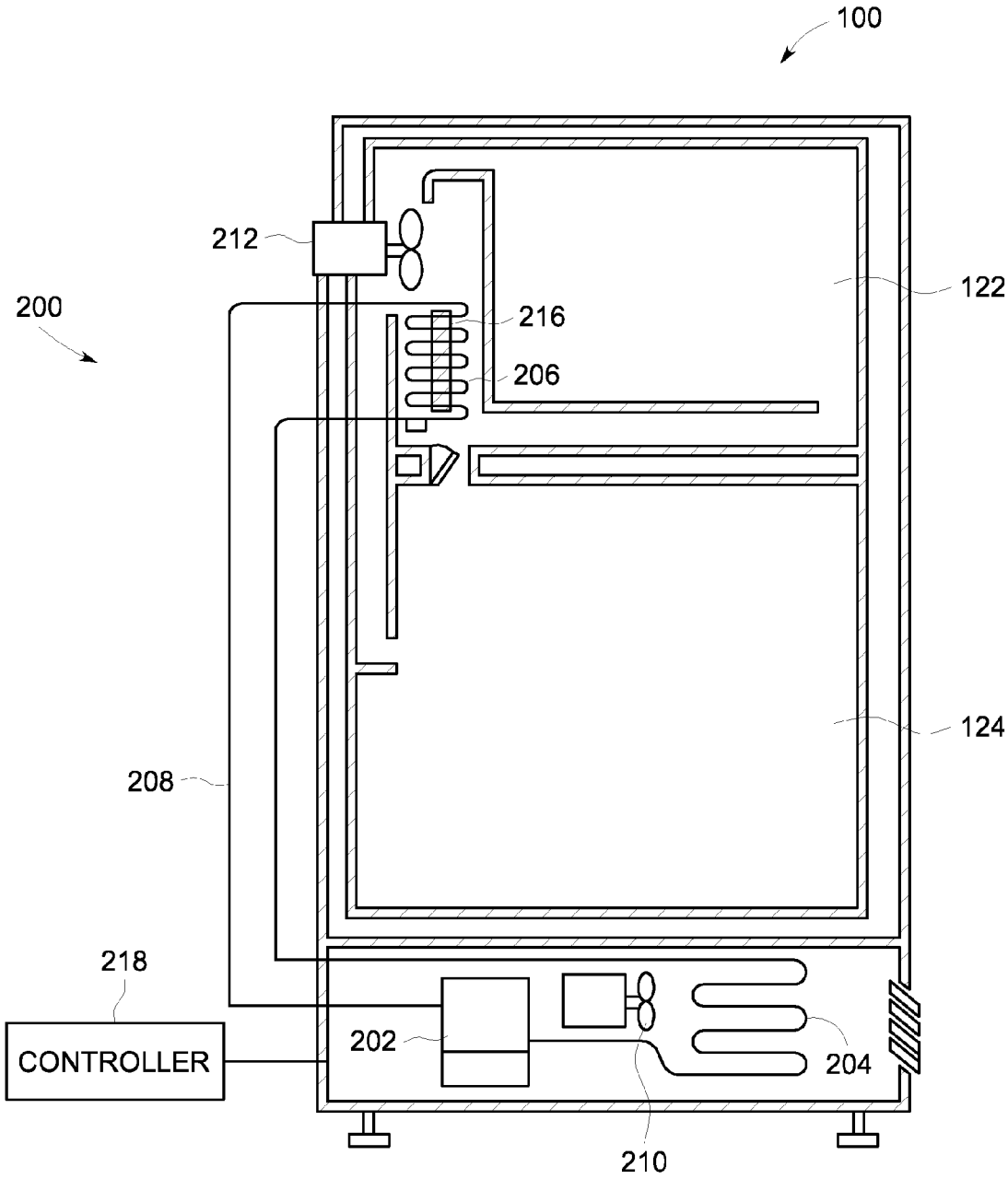
FIG. 2 is a schematic view of one embodiment of an exemplary appliance incorporating aspects of the present disclosure.

Referring to FIG. 2, in one embodiment, the exemplary components for a refrigeration system 200 for the refrigerator 100 generally includes a compressor 202, a condenser 204 and an evaporator 206. The components of the refrigeration system 200 typically communicate with each other through the refrigeration conduit 208 in a manner that is generally known in the art. As shown in FIG. 2, a condenser fan 210 is used to cool the condenser 204. Evaporator fan 212 directs an airflow stream across the coils of the evaporator 206 and into the compartments 122, 124 in a manner that is generally known. The particular arrangement, location and configuration of the refrigeration system 200 is merely exemplary, and in alternate embodiments the compressor 202, condenser 204 and evaporator 206 could be configured at any suitable location of the refrigerator 100 for providing the required heat transfer and cooling.

Operation of the compressor 202 is typically thermostatically controlled to maintain the temperature within the freezer and fresh food compartments 122, 124 within a controlled range. The evaporator 206 is generally configured to operate at temperatures below freezing. As is generally understood, there is a tendency for frost or ice to build up on the surfaces of the evaporator 206. In one embodiment, for the purpose of periodically removing accumulated frost from the surfaces of the evaporator 206, an electrical defrost heater 216 is provided. The electrical defrost heater 216 can be any suitable heater for warming the surfaces of the evaporator 206, such as for example a radiant heater. The defrost heater 216 can be periodically energized by operation of a control or controller 218.

Figure 3:
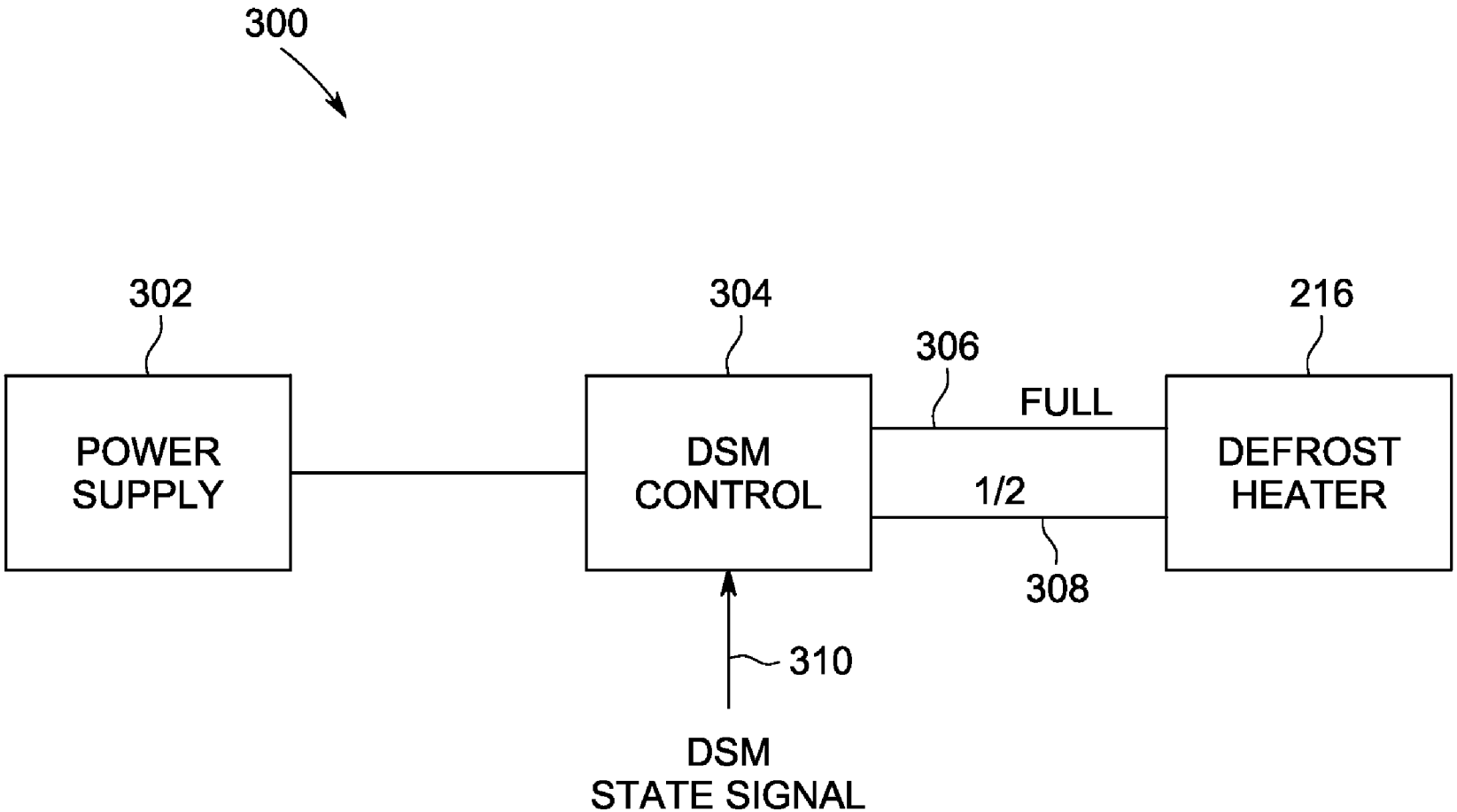
FIG. 3 is a schematic illustration of an embodiment of a defrost heater control system incorporating aspects of the present disclosure.

FIG. 3 illustrates one embodiment of a system 300 for controlling a defrost heater 216 in accordance with the aspects of the present disclosure. As shown in FIG. 3, a power supply or source 302, such as the local power grid, for example, is coupled to a DSM control 304, which in turn provides or enables a suitable supply of electrical power to the defrost heater 216. During normal operation, the power supply 302 provides power, such as household alternating current ("AC") power to the various components of the appliance 100, including the defrost heater 216. The DSM control 304 is configured to regulate whether the defrost heater 216 receives full power or one-half power to enable a full power defrost cycle or a one-half power defrost cycle of the defrost heater 216, depending upon the level of electrical power demand, which can generally be indicated by a DSM state signal 310. For example, during a period of relatively low electrical power demand, or when a DSM mode is not enabled, the defrost heater 216 will be energized by a full power electrical signal 306. During a period of relatively high electrical power demand, or when a DSM mode or state is enabled, the defrost heater 216 will be energized or powered by a one-half power electrical signal 308. A state of the DSM control 304 determines whether the defrost heater 216 receives the full power input signal 306 or the one-half power input signal 308.

In one embodiment, the state of the DSM control 304 is determined by the DSM State signal 310. The DSM State signal 310 will generally indicate a DSM state when a period of high electrical power demand exists, and the power consumption of the appliance 100 must be reduced. The DSM state signal 310 is typically generated or transmitted by the local power or utility company, or other suitable entity that determines power grid and load conditions. Generally, the DSM state signal 310 is transmitted over the power lines or via a wireless connection and is detected by, for example, the DSM control 304 in the appliance 100. Alternatively, the DSM state signal 310 can be sent over a side band via FM radio. In alternate embodiments, any suitable method of transmitting and receiving the DSM State Signal 310 can be used.

Figure 4:
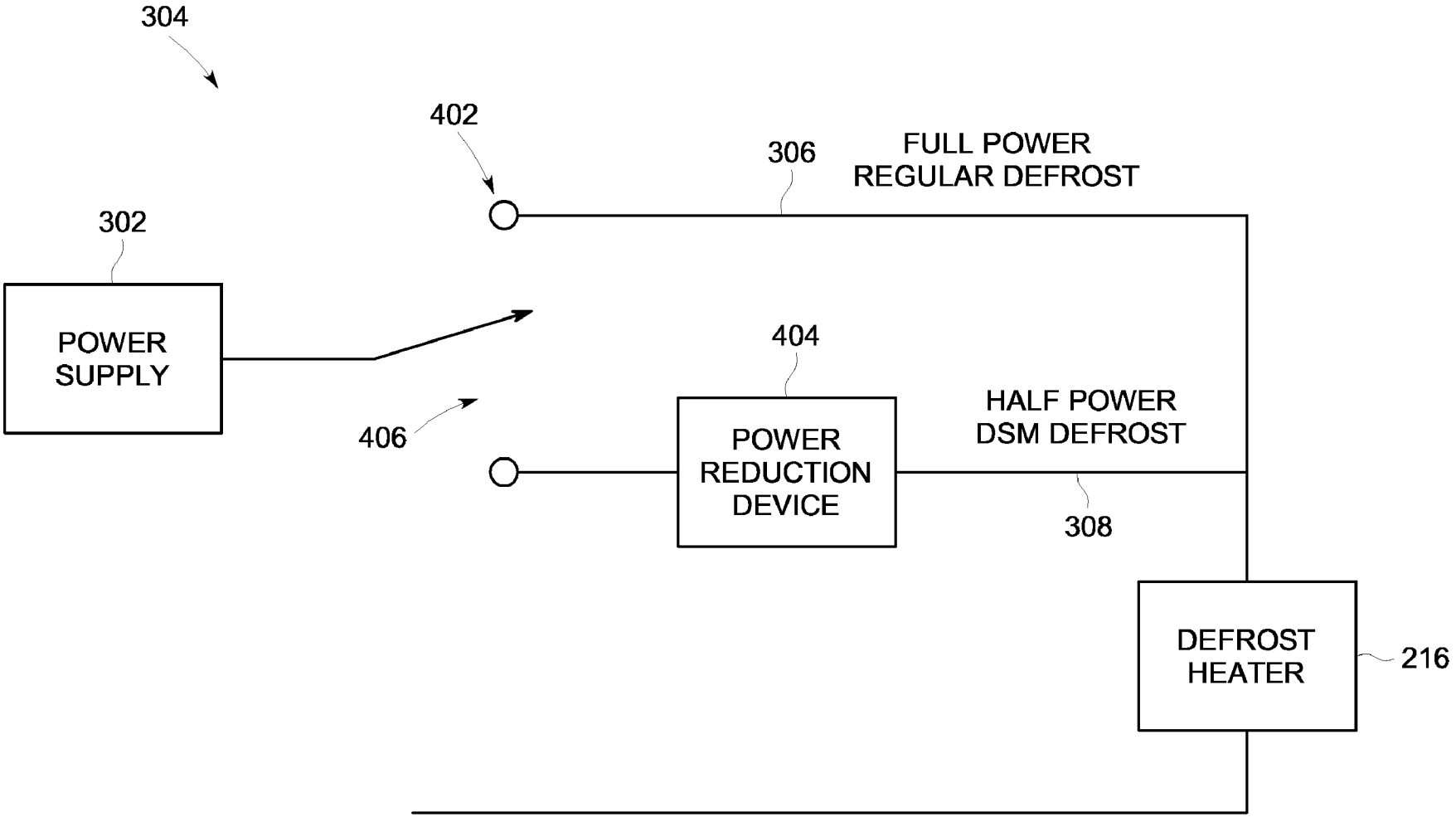
FIG. 4 is schematic illustration of an embodiment of a defrost heater control system incorporating aspects of the present disclosure.

FIG. 4 illustrates one embodiment of the DSM control 304 of FIG. 3. In this example, the power supply 302 is coupled to a switch or relay 402. The switch 402 is configured to couple the power supply 302 to one of two branches of the power supply circuit, generally referenced as 406. The first branch 306 provides the full power, regular defrost cycle. The second branch 308 provides the reduced or half power DSM defrost cycle. In one embodiment, the half power DSM defrost branch 308 includes a power reduction device 404 in series between the power supply 302 and the defrost heater 216. When the power supply 302 is connected to the half power branch 308, the power reduction device 404 will reduce the electrical power supplied to, or able to be consumed by, the defrost heater 216 by approximately one-half to comply with DSM requirements. While the aspects of the disclosed embodiments generally refer to the power supply 302 as an AC power supply, in alternate embodiments the power supply 302 can comprise a direct current (DC) power supply. In such embodiments, the power reduction device 404 will be configured to reduce a DC power supply input by approximately one-half.

In one embodiment, the power reduction device 404 comprises one or more diodes or other suitable electronic components that are configured or arranged to conduct electrical current in only one direction. In one embodiment, the power reduction device 404 comprises a standard rectifier diode.

When the power reduction device 404 is a diode and the AC power supply 302 is coupled to the half power branch 308, the diode will block one-half of the cycle of the AC power signal.

As another example, in one embodiment, the power reduction device 404 comprises a triode for alternating current (TRIAC). As is generally understood, a TRIAC is an electronic component or solid state switch that can modify the shape of the alternating current wave being supplied by the power supply 302.

Figure 5:
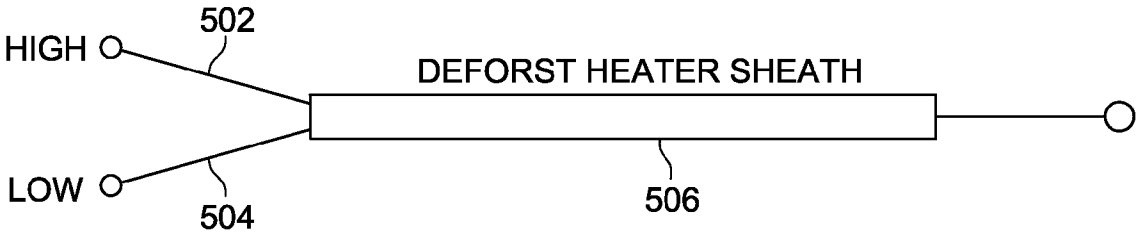
FIG. 5 is a schematic view of one embodiment of a defrost heater sheath that can be used in a system incorporating aspects of the present disclosure.

In one embodiment, referring to FIG. 5, the defrost heater 216 can comprise a two wire defrost heater sheath 506 having a high power input 502 and a low power input 504. Power from the power supply 302 is sent to the high power input 502 for a conventional defrost during low electrical power demand periods, and to the low power input 504 during high or peak electrical power demand periods. In alternate embodiments, the power reduction device 404 can comprise any suitable device for reducing a power supply input by approximately one-half.

Figure 6:
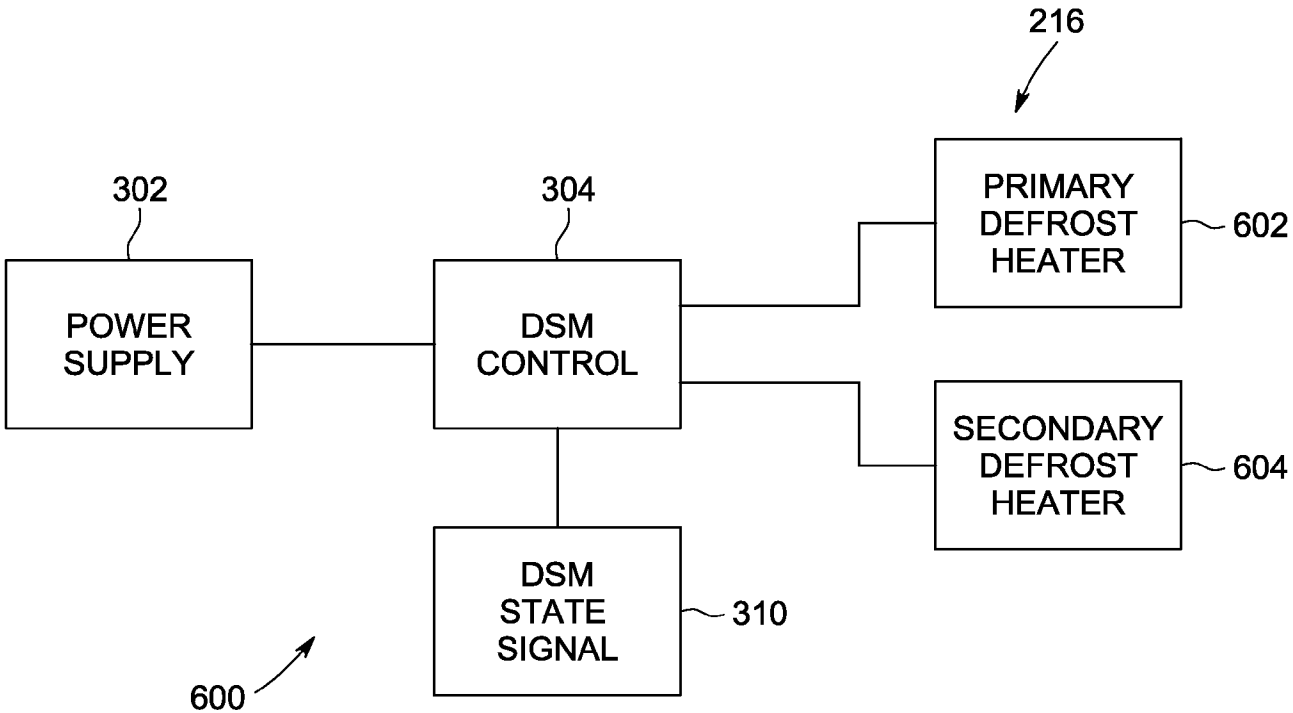
FIG. 6 is a schematic illustration of an embodiment of a defrost heater control system incorporating aspects of the present disclosure.

Referring to FIG. 6, in one embodiment, a system 600 for controlling a reduced power defrost state or cycle is shown, where the defrost heater 216 of FIG. 1 comprises two separate defrost heaters, a primary defrost heater 602 and a secondary defrost heater 604. In one embodiment, the secondary defrost heater 604 can be configured to use approximately one-half of the power used by the primary defrost heater 602. In this example, the DSM control 304 can comprise a suitable switch or relay that switches the power supply 302 between the primary defrost heater 602 and the secondary defrost heater 604. The DSM state signal 310 will be used to determine which of the defrost heaters 602, 604 is energized. During peak electrical power demand periods, the DSM control 304 will turn off the high power primary defrost heater 602 and energize the low power heater 604.

In another embodiment, both the primary defrost heater 602 and the secondary defrost heater 604 can comprise low power defrost heaters. In this embodiment, when the DSM state signal 310 indicates a state of low power demand so that a normal defrost cycle can be initiated, the DSM control 304 will enable both the primary defrost heater 602 and the secondary defrost heater 604 to be energized. If the state of the DSM signal 310 changes or indicates a high power demand state, the DSM control 304 is configured to disable one of primary or secondary defrost heaters 602, 604 so that the power consumption is reduced by the required amount.

Figure 7:
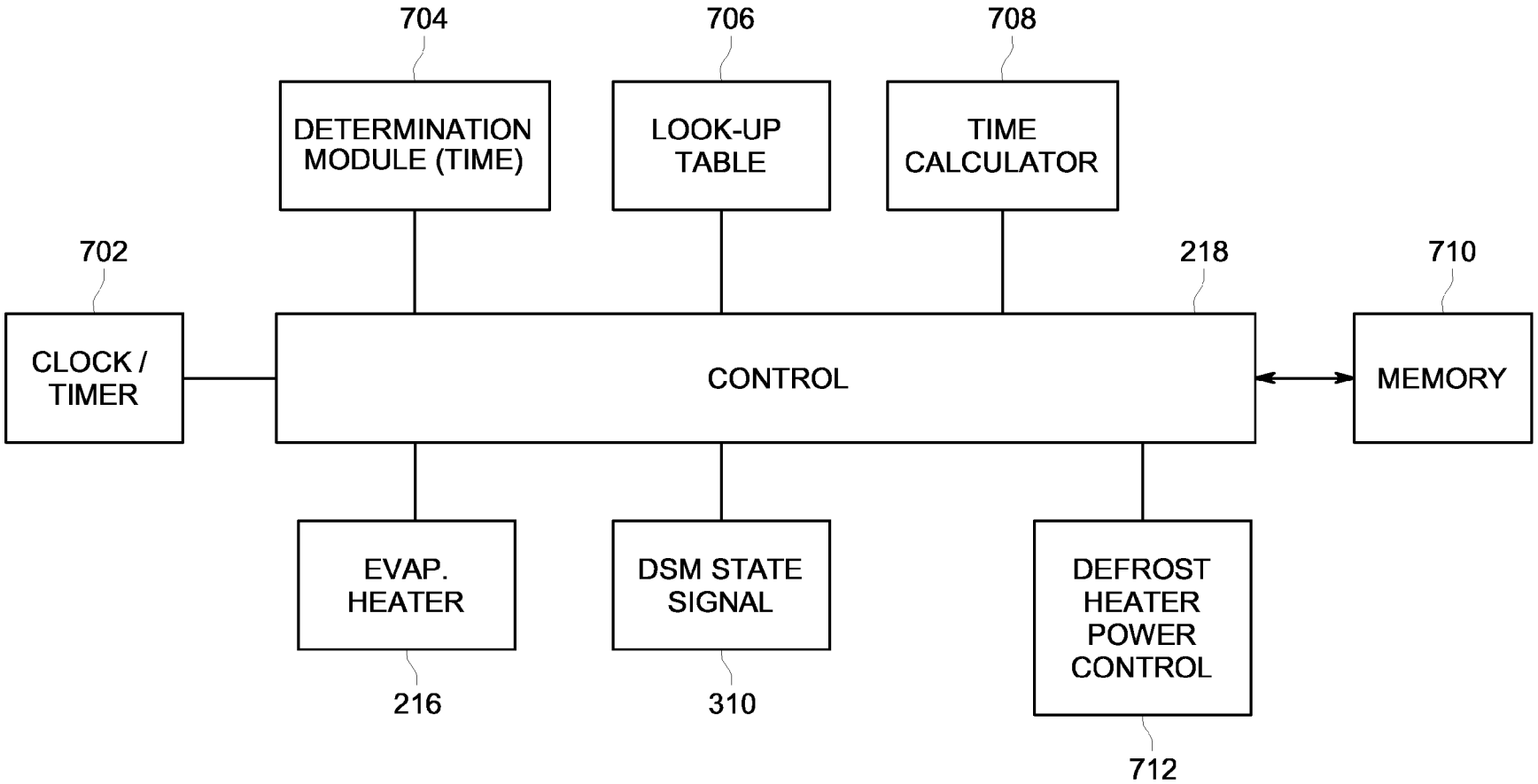
FIG. 7 is a schematic illustration of an embodiment of a defrost heater control system incorporating aspects of the present disclosure.

It can generally be anticipated that when the defrost heater 216 is powered with, or only using, one-half of the power using during a conventional defrost cycle, that the time to complete the defrost cycle will take longer than normal. As noted, it is important not to terminate a defrost cycle until all of the frost or ice has melted in order to avoid creating an ice-blocked evaporator. Any negative effects of having a longer defrost cycle are generally outweighed by the disadvantages of terminating the defrost cycle too early. In one embodiment, referring to FIG. 7, the controller 218 includes a clock/timer 702. The clock/timer 702 is generally configured to monitor, determine and set the time period of the defrost cycle. In one embodiment, when a conventional or high power defrost cycle is initiated, the timer 702 is activated. The timer 702 will control the length of the conventional defrost cycle according to a pre-determined time period or standard. When the pre-determined time period has expired, the conventional defrost cycle can be terminated. This pre-determined time period for a conventional defrost cycle will generally be understood to be established according to acceptable standards or the defrost history of the appliance 100.

When a low power defrost state or cycle is initiated during a high power defrost cycle, in one embodiment, a determination is made as to the time remaining in the defrost cycle. In one embodiment, a time determination module or calculator 704 can be used to calculate the time remaining in the defrost cycle, which can be stored or retrieved from the clock/timer 702. Based on the determination of the remaining time, a new time period for the low power defrost cycle can be calculated and set, the calculation of which can generally be a factor of the heating capability of the defroster heater 216 in a one-half power mode and the time remaining from the conventional defrost cycle. In one embodiment, the calculations can be pre-determined, stored, and retrieved from a look-up table 706 or other suitable database or memory 710. Alternatively, the time calculator 708 can incorporate a suitable low power time calculation algorithm that utilizes the remaining time from the conventional defrost cycle, the power level for the low power cycle, and/or historical time values for low power defrost cycles, to calculate a new time period for the low power defrost cycle.

In one embodiment, referring again to FIG. 7, the controller 218 can be configured to detect the DSM state signal 310 and control the switching of the power supply input to the defrost heater 216 between the standard, high power setting and the DSM state, low or half-power setting. In one embodiment, the controller 218 includes or is coupled to a Defrost Heater Power Control 712 that regulates and switches the power supplied to the defrost heater 216. For example, when the DSM state signal 310 indicates a period of low power demand, the controller 218 can cause the Defrost Heater Power Control 712 to enable a standard supply of electrical power to be delivered to the defrost heater 216. When the DSM state signal 310 indicates a period of peak or high power level demand, a DSM state, the controller 218 can cause the Defrost Heater Power Control 712 to enable a reduced supply of power, or half-power, to be delivered to the defrost heater 216.

Figure 8:
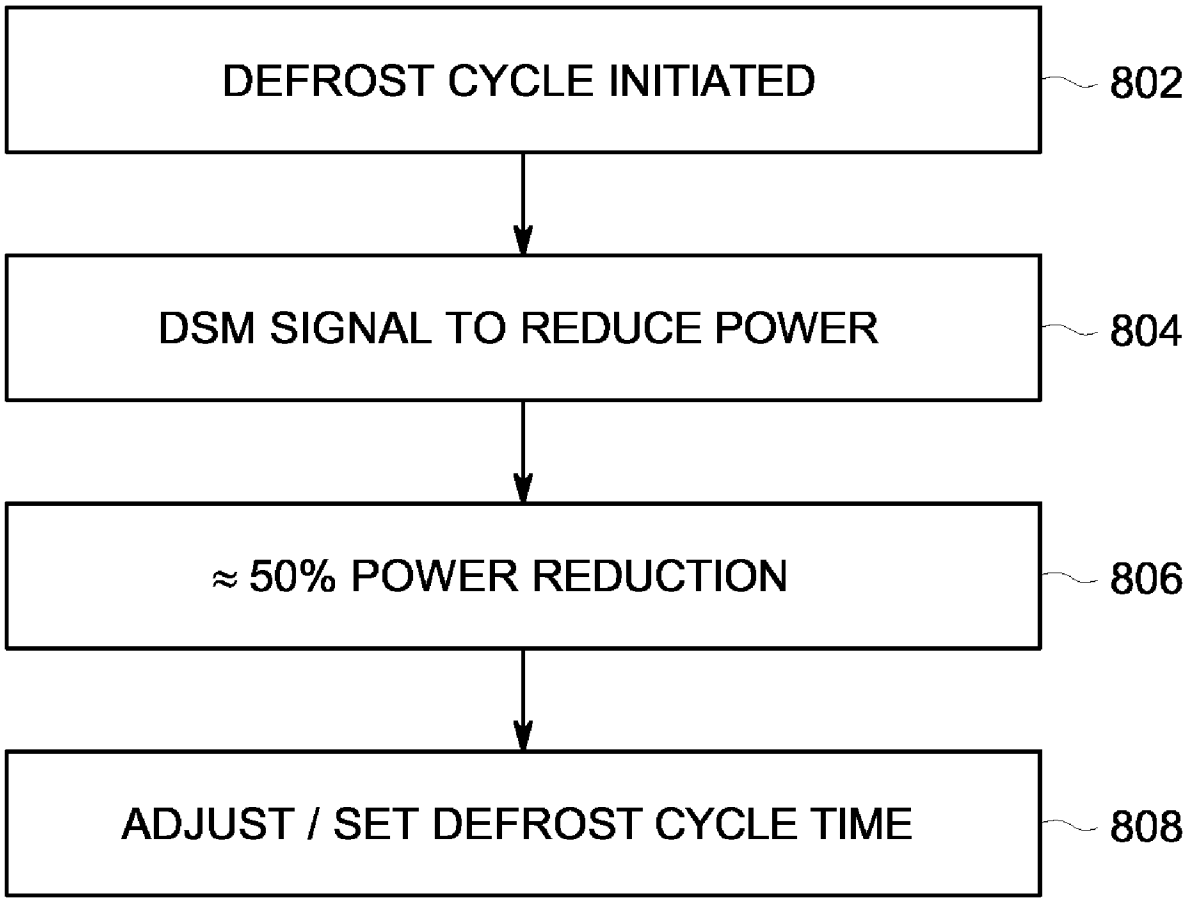
FIG. 8 is a flow chart illustrating an exemplary embodiment of a process incorporating aspects of the present disclosure.

FIG. 8 illustrates an exemplary process incorporating aspects of the disclosed embodiments. A conventional defrost cycle is initiated 802 during a period of low energy demand or usage. During this conventional defrost cycle, a DSM signal to reduce power is received 804. In accordance with the aspects of the disclosed embodiments, the electrical power supplied to, or consumed by the defrost heater 216 is reduced 806 by approximately one-half (50%), or such other suitable value. In one embodiment, a new time period for the low power defrost cycle is determined and set 808. This allows the low power defrost cycle to substantially completely melt any frost or ice accumulation even though the power consumption of the defrost heater 216 is reduced.

The aspects of the disclosed embodiments generally provide a reduced power consumption state or mode for a defrost heater in a refrigeration and cooling appliance such as a refrigerator. In order to comply with DSM requirements, power consumption of an appliance such as a refrigerator must be able to be reduced by approximately one-half during periods of peak energy usage or demand. The aspects of the disclosed embodiments can detect a need to enter a reduced power consumption state and reduce the power consumption of the evaporator heater while ensuring that the defrost cycle is not prematurely terminated, which would result in ice and frost buildup.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto

What is claimed is:

1. A method comprising:

providing a standard supply of electrical power to a defrost heater during a standard defrost cycle for a refrigeration system of an appliance;

detecting a high energy demand period during the standard defrost cycle; and enabling a reduced consumption of electrical power by the defrost heater in a low power defrost cycle.

2. The method of claim 1, wherein enabling a reduced consumption of electrical power by the defrost heater in a low power defrost cycle comprises reducing the standard supply of electrical power to the defrost heater by approximately 50%.

3. The method of claim 1, wherein enabling a reduced consumption of electrical power by the defrost heater in a low power defrost cycle comprises:

automatically switching the standard supply of electrical power to the defrost heater to a reduced power input circuit in the low power defrost cycle.

4. The method of claim 3, wherein the reduced power input circuit comprises a power reduction device coupled between the standard supply of electrical power and the defrost heater.

5. The method of claim 4, wherein the power reduction device comprises a diode or TRIAC device between the standard supply of electrical power and the defrost heater.

6. The method of claim 5, wherein the power reduction device comprises a defrost heater sheath having a high power terminal and a low power terminal, and enabling a reduced consumption of electrical power defrost by the defrost heater in a low power defrost cycle further comprises switching the standard supply of electrical power from the high power terminal to the low power terminal.

7. The method of claim 1, wherein enabling a reduced consumption of electrical power by the defrost heater in a low power defrost cycle comprises switching a power input to the defrost heater from a high power input to a one-half power input.

8. The method of claim 1, wherein the defrost heater comprises a primary defrost heater and a secondary defrost heater, and enabling a reduced consumption of electrical power by the defrost heater in a low power defrost cycle comprises energizing only one of the primary defrost heater and the secondary defrost heater.

9. The method of claim 1, wherein enabling a reduced consumption of electrical power by the defrost heater in a low power defrost cycle comprises increasing a defrost cycle time period by a pre-determined time factor.

10. The method of claim 9, wherein increasing a defrost cycle time period comprises:

determining a remaining time period in the standard defrost cycle from a time the reduced consumption of electrical power by the defrost heater is enabled; and determining a new time period for the low power defrost cycle based on the time period remaining in the standard defrost cycle and a heat output power of the defrost heater in the low power defrost cycle.

11. A control system for a defrost heater in a refrigeration system, comprising:

a power supply connection;

a controller configured to determine a demand side management state signal; and a power switching unit coupled between the power supply connection and the defrost heater, the power switching unit being configured to switch a power consumption state of the defrost heater in a defrost cycle from a standard power consumption mode to a reduced power consumption mode when the demand side management state signal is detected during the standard power consumption mode.

12. The control system of claim 11, wherein the power switching unit comprises a power reduction device configured to reduce a supply of power from the power supply connection to the defrost heater in the reduced power consumption mode.

13. The control system of claim 12, wherein the power reduction device comprises a diode or a TRIAC between the power supply connection and the defrost heater.

14. The method of claim 12, wherein the power reduction device comprises a defrost heater sheath having a high power terminal and a low power terminal, and the power switching unit is further configured to switch the power supply connection from the high power terminal to the low power terminal in the reduced power consumption mode.

15. The control system of claim 12, wherein the defrost heater comprises a primary defrost heater and a secondary defrost heater, and the power switching unit is configured to couple only one of the primary defrost heater and secondary defrost heater to the power supply connection in the reduced power consumption mode.

16. The control system of claim 12, further comprising a defrost cycle timing device, the defrost cycle timing device being configured to increase a defrost cycle time period by a pre-determined factor in the reduced power consumption mode.

17. A refrigerator comprising:

a compartment;

an evaporator in heat transfer association with the compartment;

a defrost heater associated with the evaporator; and a controller configured to switch an energy consumption state of the defrost heater from a standard energy consumption state to a reduced energy consumption state when a peak power demand state is detected.

18. The refrigerator of claim 17, further comprising:

a source of electrical power for powering the defrost heater; and a power reduction device coupled to the controller, the power reduction device being configured to switch the source of electrical power from a standard power level to a reduced power level when the peak power demand state is detected.

19. The refrigerator of claim 18, wherein the power reduction device comprises a diode or TRIAC device, the power reduction device being configured to connect the diode or TRIAC device between the source of electrical power and the defrost heater when the peak power demand state is detected.

20. The refrigerator of claim 17, further comprising a defrost cycle timing device coupled to the controller, the defrost cycle timing device being configured to increase a defrost cycle time period by a pre-determined factor in the reduced power consumption mode.

* * * * *

UNITED STATES PATENT AND TRADEMARK OFFICE

CERTIFICATE OF CORRECTION

PATENT NO. : 8,291,718 B2
APPLICATION NO. : 12/874320
DATED : October 23, 2012
INVENTOR(S) : Brent Alden Junge et al.

It is certified that error appears in the above-identified patent and that said Letters Patent is hereby corrected as shown below:

In Column 2, Line 62, delete “is” and insert -- is a --, therefor.

In Column 3, Line 36, delete “buildup” and insert -- buildup. --, therefor.

In Column 7, Line 43, delete “hereto” and insert -- hereto. --, therefor.

In Column 8, Line 56, in Claim 14, delete “method” and insert -- control system --, therefor.

Signed and Sealed this
Twenty-second Day of January, 2013

David J. Kappos

David J. Kappos
*Director of the United States Patent and Trademark Office*